United States Patent [19]

Fowler

[11] Patent Number: 4,642,586

[45] Date of Patent: Feb. 10, 1987

[54] LOW SWR HIGH POWER MULTIPLE WAVEGUIDE JUNCTION

[75] Inventor: Wayne D. Fowler, Burlington, Mass.

[73] Assignee: Adams-Russell, Waltham, Mass.

[21] Appl. No.: 602,347

[22] Filed: Apr. 20, 1984

[51] Int. Cl.[4] ..... H01P 5/20

[52] U.S. Cl. ..... 333/122; 333/125

[58] Field of Search ..... 333/121, 122, 124–126, 333/137

[56] References Cited

U.S. PATENT DOCUMENTS

| | | | |
|---|---|---|---|
| 2,853,683 | 9/1958 | Murphy | 333/122 |
| 3,315,183 | 4/1967 | Bunn et al. | 333/122 |
| 3,375,472 | 3/1968 | Walker | 333/122 |
| 3,629,734 | 12/1971 | Siekanowicz et al. | 333/122 |
| 4,039,975 | 8/1977 | Debski | 333/122 |
| 4,074,265 | 2/1978 | True | 333/122 X |

*Primary Examiner*—Paul Gensler

*Attorney, Agent, or Firm*—Louis H. Reens

[57] ABSTRACT

A multiple waveguide junction such as a magic T is described capable of coupling large average and peak powers with a low standing wave ratio over a wide bandwith. The magic T structure employs waveguide arms which meet at a common junction region and has a plane of symmetry that bisects both the E and H input waveguide arms. The latter arms each have necked down segments so as to improve the bandwidth of the structure. Impedance matching elements are employed in the junction region. One element has a ridge-like shape selected to provide an impedance match to the H input waveguide arm. Other matching elements are employed to provide a low SWR over a bandwidth that approaches a 3:1 ratio.

24 Claims, 9 Drawing Figures

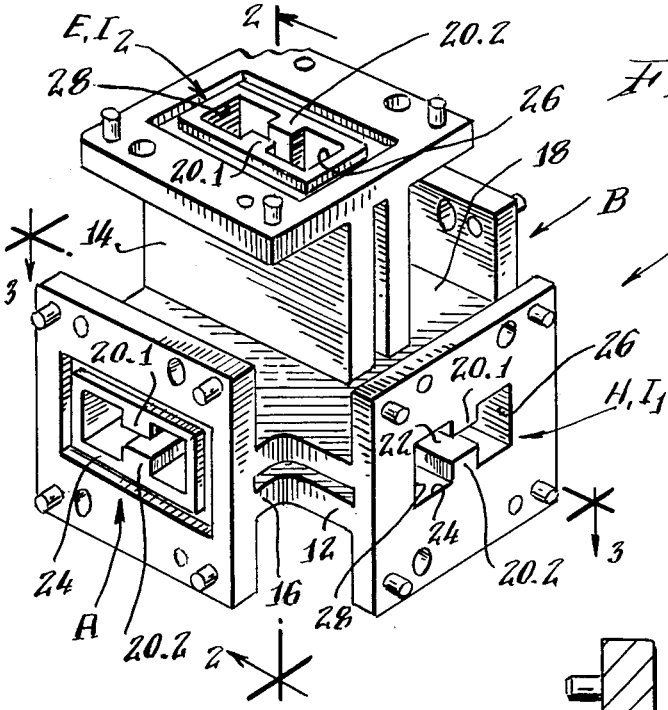
Fig. 1
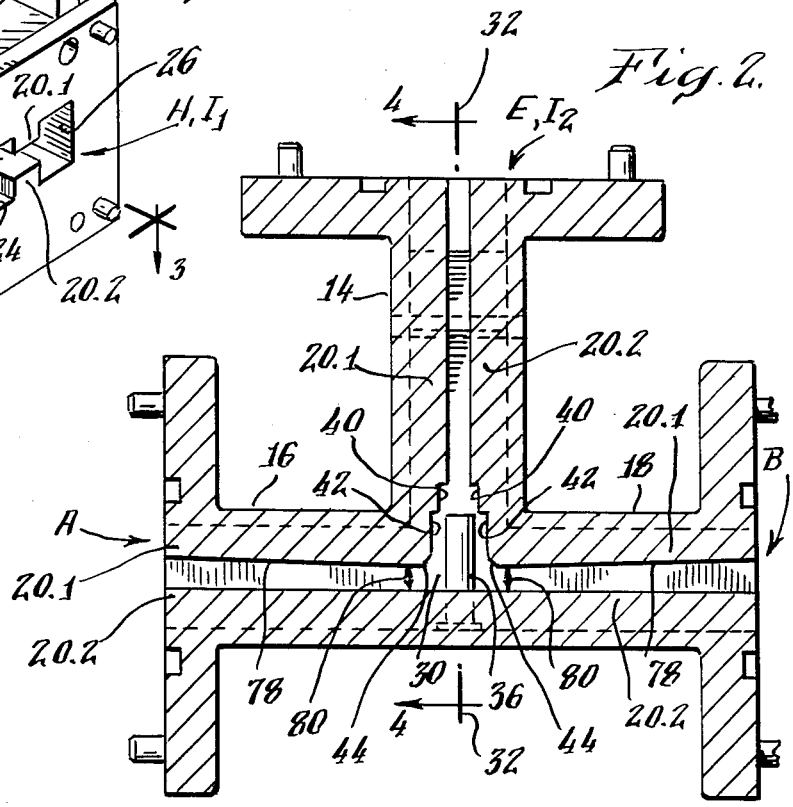
Fig. 2.
Fig. 3.
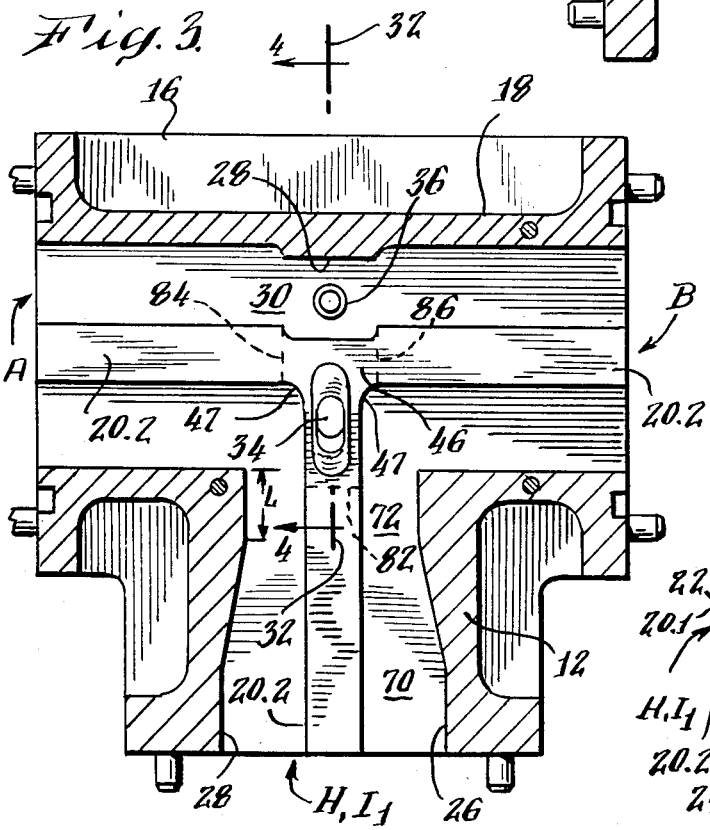
Fig. 4.
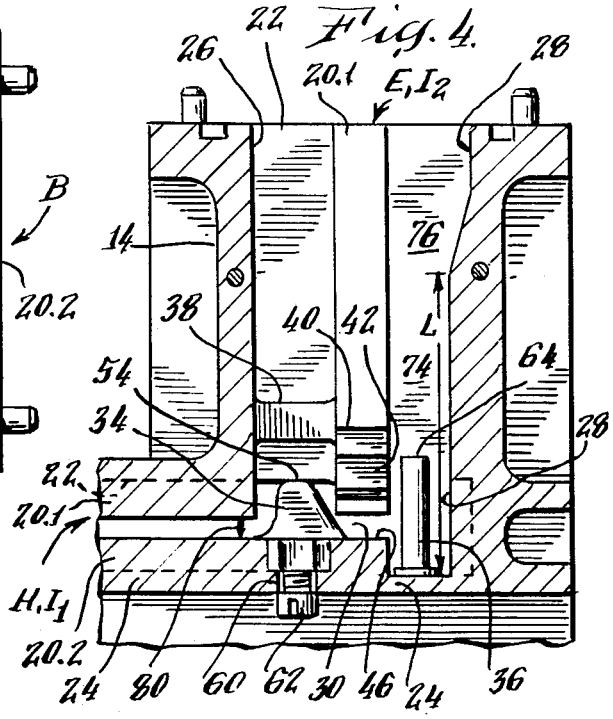

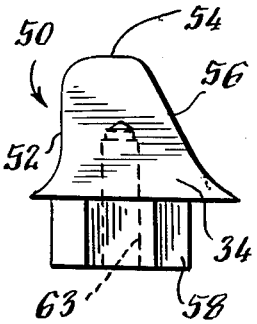
Fig. 6.
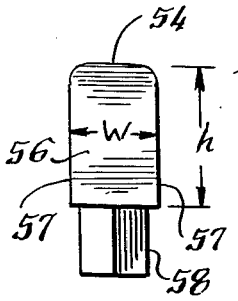
Fig. 7.
Fig. 5.
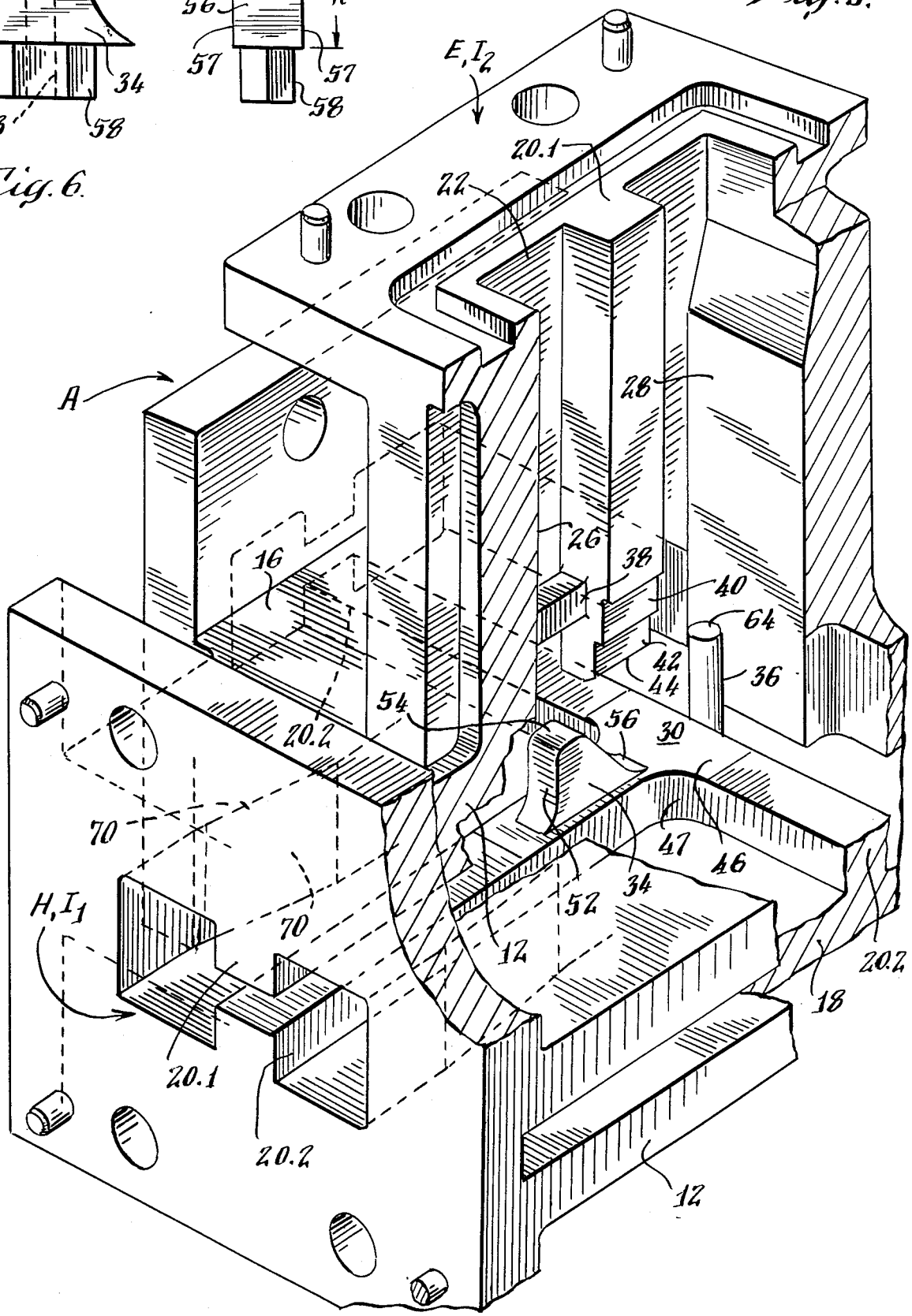

LOW SWR HIGH POWER MULTIPLE WAVEGUIDE JUNCTION

FIELD OF THE INVENTION

This invention relates to a wide bandwidth high power multiple waveguide junction. More specifically this invention relates to a magic T waveguide structure capable of coupling high peak powers without arcing over a wide bandwidth with a low standing wave ratio (SWR).

BACKGROUND OF THE INVENTION

Magic T waveguide structures, also known as hybrid Tees, are well known and have been extensively described. See for example pages 306–308 in Principles of Microwave Circuits, Edited by Montgomery, Dicke and Purcell, published by Dover Publications, N.Y. 1965. A magic T commonly involves a four port waveguide structure having effectively four waveguides joined at a junction region with at least one symmetry plane that bisects a pair of input waveguides which are commonly referred to as the E and H input arms or ports. The remaining waveguides are output arms. When the waveguides are coupled to matched loads, power into any one input arm is evenly divided among and coupled to the output arms without transmittal of power to the other input arm.

Since, the power division gives rise to a reflected wave in the input arm, the reflection is elminated by introducing impedance matching elements. These elements typically are symmetrically placed with respect to the symmetry plane in the junction region. The elements may be a post and an iris to respectively provide an impedence match to the input arms.

The waveguides used in the magic T may be conventional rectangular guides or multiple ridge waveguides. The matching elements may be adjustable tuning screws that are typically adjusted for the lowest SWR over the bandwidth of interest. The tuning screws, however, tend to limit the power handling ability of the magic T because of arcing.

Microwave devices have been proposed with a waveguide segment having a reduced cross-sectional area. Such structures have been used in couplers and high power ferrite switches to eliminate the propagation of higher order modes.

Although some of these prior art techniques have been individually applied to achieve moderate power handling ability over a limited bandwidth, a basic shortcoming in available magic T waveguide strucures is that high peak powers (of say in excess of about 20 kilowatts) cannot be accommodated with a low SWR over wide bandwidths that approach a 3:1 bandwidth ratio.

SUMMARY OF THE INVENTION

With a multiple waveguide junction device in accordance with the invention a low SWR is achieved over a wide bandwidth while high powers can be coupled through the device without arcing. This is obtained by placing impedance matching elements of a particular shape in a plane of symmetry and reducing the crossectional area of the input arms.

As described herein for a magic T multiple waveguide junction in accordance with the invention a rectangular double ridged waveguide is used. One input waveguide arm, corresponding to the H plane input port, has a reduced cross-section formed by converging both opposing walls that face each other across the larger dimension of the rectangular waveguide. The smaller cross-section portion extends to the junction region.

The other input waveguide arm, corresponding to the E plane port, also has a reduced crossection. However, this is formed by converging one opposing wall towards the other across the larger dimension of the arm.

The reduction of the cross-sections of these input arms is selected to achieve enhanced impedance matching without a cut-off of low frequencies within the wide bandwidth of interest while enabling the transmittal of high peak power levels without arcing.

Matching elements are employed in alignment with a ridge of one of the input waveguide arms, such as the H port, to provide a wide bandwidth impedance match. One matching element has a ridge-like shape and is adjustable for tuning along the axis of the waveguide arm with which the element is aligned. The ridge shape impedance matching element has a height that extends virtually to the level of a wall of the latter waveguide arm.

The ridge shaped impedance matching element has front and back surfaces whose slopes are selected to provide the reactive impedance needed for impedance matching of the input arm.

Further impedance matching is obtained by selective shaping of the junction ends of the ridges of the E input waveguide arm and the use of a post-shaped matching element.

With a magic T waveguide structure in accordance with the invention high peak powers can be coupled, of the order of 55 KW without arcing with a low SWR less than about 1.5 to one over a wide bandwidth that approaches a 3:1 ratio.

It is, therefore, an object of the invention to provide a multiple waveguide junction such as a magic T which is capable of coupling large peak powers with a low SWR over a wide bandwidth.

These and other advantages and objects of the invention can be understood from the following description of a magic T in accordance with the invention and described in conjuntion with the drawings.

BRIEF DESCRIPTION OF DRAWINGS

FIG. 1 is a perspective view of a magic T in accordance with the invention.

FIG. 2 is a section view of the magic T shown in FIG. 1 taken along a line 2—2 in FIG. 1.

FIG. 3 is a section view of the magic T shown in FIG. 1 taken along a line 3—3 in FIG. 1

FIG. 4 is a sectio view taken along the line 4—4 in FIG. 2 and FIG. 3.

FIG. 5 is a partial perspective broken away view of the magic T shown in FIG. 1 but with the magic T as shown in FIG. 1 rotated clockwise 90° about a vertical axis.

FIG. 6 is an enlarged side view in elevation of a ridge shaped impedance matching element employed in the magic T of FIG. 1.

FIG. 7 is front view in elevation of the ridge shaped impedance matching element shown in FIG. 6.

DETAILED DESCRIPTION OF EMBODIMENT

Figure 8:
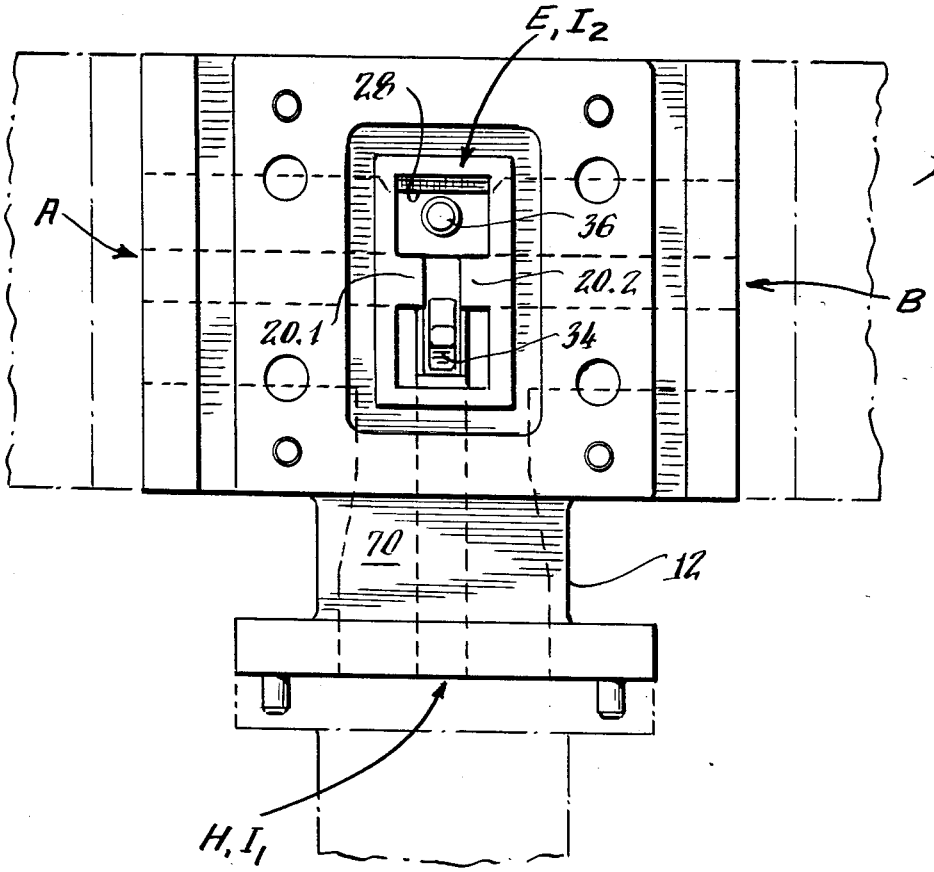
FIG. 8 is a front view in elevation of the E port of the magic T of FIG. 1

With reference to FIG. 1 a magic T waveguide structure 10 in accordance with the invention is shown formed with multiple waveguide arms 12, 14, 16 and 18. Arms 12 and 14 are input arms, respectively identified as the $I_1$ or H input port and $I_2$ or E input port. Arms 16, 18 are identified as output ports A and B.

Magic T structure 10 uses like sized double ridged rectangular waveguides each of which has a pair of opposing centrally located ridges 20.1, 20.2 protruding from the larger parallel walls 22, 24. The waveguide arms 12–18 each also have short parallel walls 26, 28. Other waveguides may be used as are well known in the microwave field.

The size of the waveguides used depends on the frequencies in which the magic T 10 has to operate. For one operating bandwidth for a magic T of this invention, i.e. from about 6 to about 18 Giga Hertz and applicable to the embodiment shown herein, the lengths of the short walls 26, 28 are each about 0.320 inches (about 8 mm) and the long walls 22, 24 about 0.720 inches (about 18 mm). Ridges 20 are about 0.173 inches wide (about 4.5 mm) and protrude about 0.110 inches (about 2.8 mm) from long walls 22, 24. The dimensions described hereafter are applicable for this sized waveguide. For different waveguides proportionally different dimensions apply.

As illustrated in the various views of FIGS. 2–5 magic T waveguide structure 10 has a junction region 30 where the respective waveguide arms 12–18 terminate. As is well known in the art, impedance matching elements are placed in the junction region 30 preferably symmetrically placed with respect to a symmetry plane 32 of the magic T 10. The magic T of FIG. 1 has a single electromagnetic symmetry plane 32 of the junction (see FIGS. 2 and 3) which effectively bisects both input arms 12 and 14.

Junction 30 contains a plurality of impedance matching elements. A pair of such elements 34, 36 are symmetrically positioned with the symmetry plane 32 and in alignment with the central ridge 20.2 of the input arm 12. Element 34 serves to primarily impedance match the H input arm 12 while element 36 primarily matches the impedance of the E input arm 14. An iris element 38 (see FIGS. 4 and 5) is located at the end of the E input arm 14 near junction region 30. The central ridges 20.1 and 20.2 of the E input arm 14 are further provided at their end segments near junction region 30 with recessing steps 40, 42 and a contoured rounded end 44, see FIGS. 2 and 4, for the addition of a reactive element, a capacitance, and thus for further improvement in impedance matching of the E input waveguide arm 14. The lengths of the steps 40, 42 may be each about 0.114 inches (about 2.9 mm) with a height of about 0.001 inches (about 0.3 mm).

The ridge shaped element 34 is particularly effective for impedance matching and is seated as illustrated in FIGS. 3, 4 and 5 on a flat surface 46. Surface 46 is the top of the ridge 20.2 (see FIGS. 4 and 5) of waveguide arm 12 which extends into junction region 30, see FIG. 5, to smoothly merge at corners 47 with ridges 20.2 for the output waveguide arms 16 and 18. The ridge shaped element 34 as illustrated in FIGS. 4, 5, 6 and 7 has a front surface 50 that faces input waveguide arm 12. Surface 50 extends with a smooth transition from surface 46 to an almost vertical segment 52 which is essentially transverse to the axis of input waveguide arm 12. Segment 52 in turn smoothly merges with a top surface 54 that is horizontal and parallel to the axis of the input waveguide arm 12.

The top surface 54 smoothly merges with a rear sloping surface 56 that forms an angle of about 30° with a vertical to surface 46. The ridge element has a width, W, as defined by straight sidewalls 57, that is slightly smaller than the width of waveguide ridge 20.2. Element 34 has a lower mounting stud 58 that extends into a slot 60 in ridge 20.2 (see FIG. 4). A screw 62 engages a threaded counter bore 63 in stud 58 to firmly seat ridge element 34. The slot 60 permits ridge element 34 to be adjusted along the axis of the input waveguide arm 12 for tuning purposes.

The height h of the ridge element 34 is selected for best impedance matching and so that the top surface 54 is placed preferably at a level that is greater than one-half the width of the smaller waveguide dimension. In the embodiment, top surface 54 almost reaches the level of the wall 22, see FIG. 4. The dimensions for ridge element 34 for the waveguide size as previously described may be a width w of 0.125 inches (about 3 mm), a height h of about 0.185 inches (about 4.7 mm), a rounding of the bottom of front surface along a 0.110 inches (about 2.8 mm) radius and a straight vertical wall segment 52 that is about 0.050 inches (about 1.3 mm). The top surface 54 smoothly merges with the front and back surfaces 50, 56 along a 0.050 inch (about 1.3 mm) radius and is about 0.110 inches (about 2.8 mm) long.

Matching element 36 is in the form of a post that is seated on wall 24 of output waveguide arms 16, 18 (see FIG. 3). The top 64 of post 36 extends beyond the wall 22 of waveguide arms 12, 16, 18 into the E port 14, see FIG. 4.

As shown in FIGS. 4 and 5 iris matching element 38 is rectangular in shape and is located in E waveguide arm 14 near the junction region 30. Element 38 is an integral part of wall 22 and extends between short wall 26 and ridge 20.1. The height of element 38 is less than that of ridge 20.1, or about 0.062 inches (about 1.6 mm) and is spaced about 0.250 inches (about 6.3 mm) from the end 44 of ridge 20.1.

With these impedance matching features acceptable standing wave ratios can be achieved, however, only over a limited bandwidth. Accordingly, a further significant feature of the invention involves a "necking down" or reduction in cross-section of the E and H input waveguide arms 12 and 14 as well as a small amount in output arms 16, 18. This involves as shown in FIG. 3 a gradual convergence towards each other of opposing short walls 26, 28 for the H waveguide arm 12 at 70 to form a reduced cross-sectional waveguide section 72 near junction region 30.

A similar cross-sectional reduction as shown in FIG. 4 is made at 74 for the E waveguide arm 14, but by converging only the short wall 28 at 76.

The reduced cross-sections at 72 and 74 are selected in size so as to eliminate undesirably high SWR levels in the desired operating bandwidth, particularly those occurring towards the high end of the bandwidth. The reduction in cross-section, however, is not made so large as to cause a cut-off of low frequencies within the desired operating bandwidth.

The reduction in cross-section for the H waveguide arm 12 commences with an initial distance between short walls 26, 28 of about 0.720 inches (about 18.3 mm) until the waveguide is necked down to about 0.580 inches (about 14.7 mm). This represents a reduction in cross-sectional area of about 20 to 25% for the waveguide arm 12. The length L of the reduced cross-section 72 is made sufficiently long to suppress a resonance at the high end of the bandwidth. For the H input waveguide 12 the length L of section 72 is about 0.260 inches (about 6.6 mm) and the length of the transition zone 70 about 0.4 inches (about 10 mm).

The reduction in cross-section for the E waveguide arm 14 also starts with the waveguide dimension of about 0.720 inches but extends down to about 0.667 inches (about 17 mm). This represents a reduction in cross-sectional area of about 10%. The length L of the reduced cross-section is about 1.0 inches (about 25.4 mm) and as shown in FIG. 4 continues down to wall 24 in output arms 16, 18. The length of the transition zone is about 0.274 inches (about 7 mm).

As shown in FIG. 2 additional necking down in the form of a slight taper 78 is employed. This is effective in the smaller dimension of the waveguide arms and occurs in output waveguide arms 16, 18 and input arm 12 between opposite ridges 20.1 and 20.2 to enchance the match to the E port 14 and thus the matching of power from the junction region 30 to external devices. The amount of taper is such that the gap 80 at junction 30, see FIG. 2, between opposing central ridges 20.1 and 20.2 is reduced from about 0.220 inches (about 5.58 mm) to about 0.2075 inches (about 5.27 mm). The taper ends short of the junction as shown by way of a projection in FIG. 3 of these tapered ends with dotted lines 82, 84 and 86 for arms 12, 16 and 18 respectively.

Figure 9:
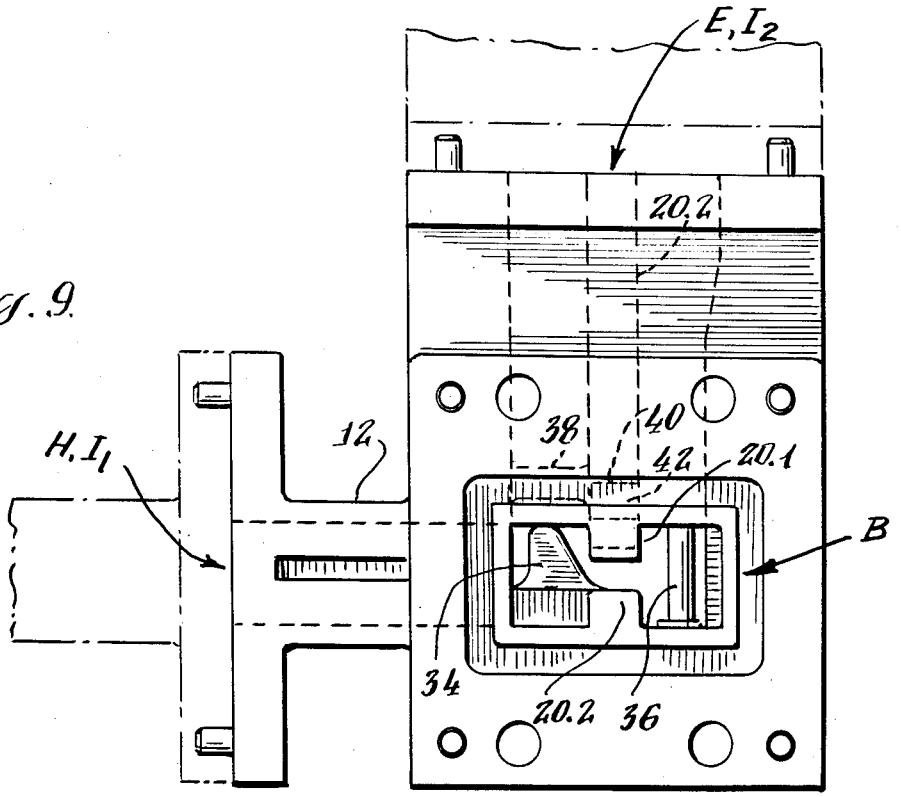
FIG. 9 is a front view in elevation of one of the output ports of the magic T of FIG. 1.

The various ports, E, H, A and B are shown provided with alignment studs and holes on mounting flanges as suggested in the views of FIGS. 8 and 9 using established microwave practices.

With a magic T structure 10 in accordance with the invention the use of tuning screws as employed on conventional devices can be dispensed with. This avoids potential arcing problems while permitting a signifiant increase in power handling capability. For example a prior art magic T using tuning screws may have a typical bandwidth ratio of about 2.4 to 1 and handle one KW of average power and 14 KW of peak power.

A magic T in accordance with the invention can operate at substantially higher average power, in excess of several kilowatts, with a peak power of the order of 55 KW and with a low SWR over a bandwidth that approaches a three to one ratio.

Variations from the described embodiment can be made. For example, the ridge-shaped matching element need not be adjustable. Variations from the described embodiment may be made without departing from the scope of the invention.

What is claimed is:

1. A low SWR, wide bandwidth, high power handling Magic T multiple arm waveguide junction comprising:

a Magic T mulitple arm waveguide structure having a common junction region where at least first and second waveguide input arms may deliver power to a pair of waveguide output arms, said junction region having a first matching element located in alignment with the first waveguide input arm and being shaped to provide an impedance match to the first input arm while enabling the handling of high peak power without arcing, said junction region having a second matching element located generally in alignment with the first waveguide input arm and being shaped to provide an impedance match to the second waveguide input arm, said first and second input arms each having near the junction region a necked down waveguide portion whose cross-section is smaller in area than the input arms cross-sections that are away from the junction region, said necked down waveguide portions being so selected in area as to enhance impedance matching of the input arms to the waveguide structure over a desired bandwidth without low frequencies within said desired bandwidth being cut-off by the necked down waveguide portion, and wherein the magic T has rectangular waveguides formed of opposing normally parallel walls and wherein said necked down segment of said first input arm is obtained by a reduction in the width of the largest dimension of the first input waveguide arm with a displacement, towards each other, by both opposing shorter walls.

2. The waveguide junction as claimed in claim 1, wherein said necked down waveguide portion of said second input arm is obtained by a reduction in the width of the largest dimension of the second input waveguide arm with a displacement of one short wall.

3. The waveguide junction as claimed in claim 2, wherein said rectangular waveguides have multiple ridges with said matching elements located in the junction region in alignment with a ridge of said first input waveguide arm.

4. The waveguide junction as claimed in claim 2 and further including tapered segments which neck down the smaller dimension of selected waveguide arms.

5. The waveguide junction as claimed in claim 4, wherein said tapered segements are formed on ridges in said selected waveguide arms.

6. The waveguide junction as claimed in claim 3, wherein the central ridges of the second input waveguide arm terminate at the junction region and each have end segments of reduced height.

7. The waveguide junction as claimed in claim 6, wherein the end segments have recessed steps at said junction region.

8. The waveguide junction as claimed in claim 6, wherein the second input waveguide arm is further provided with an iris for enhanced impedance matching.

9. The waveguide junction as claimed in claim 3, wherein said first and second input waveguides are necked down in an amount sufficient to reduce their crosssectional areas in the range from about 10% to about 25%.

10. The waveguide junction as claimed in claim 3, wherein said first input waveguide arm corresponds to the H plane input port and said second arm corresponds to the E plane input port.

11. The waveguide junction as claimed in claim 3, wherein said first matching element has a ridge like shape.

12. The waveguide junction as claimed in claim 11 wherein a central ridge of the first input waveguide arm has a portion which extends into the junction region and smoothly merges with corresponding ridges in the pair of output arms, said ridge shaped matching element being mounted on said central ridge portion to extend upwardly to a level so that the combined height of the ridge shaped element and the central ridge on which the element is seated is greater than about one-half the smaller dimension of the waveguide.

13. The waveguide junction as claimed in claim 12, wherein said combined height is approximately equal to said smaller waveguide dimension.

14. The waveguide junction as claimed in claim 12, wherein said ridge shaped element has a front surface that faces the first input waveguide arm and extends in a smoothly curved manner from a low end of the ridge to its top along a desired rounded curvature.

15. The waveguide junction as claimed in claim 14, wherein said ridge shaped element has a front surface segment that is transverse to the axis of the first input waveguide arm.

16. The waveguide junction as claimed in claim 15, wherein said ridge shaped element has a rear surface that slopes down to the central ridge extension portion.

17. The waveguide junction as claimed in claim 11 and means for adjustably mounting said ridge shaped impedance matching element for adjustment either towards or away from said first input waveguide arm.

18. The waveguide junction as claimed in claim 1, wherein said waveguide structure has an electromagnetic plane of symmetry which bisects the first and second input arms, and wherein said first and second matching elements are generally symmetrically located with the plane of symmetry.

19. The waveguide junction as claimed in claim 12, wherein said second matching element is a post which is seated on a wall of the output arms and has a height sufficient to extend into an input waveguide arm.

20. A low SWR, wide, about three to one, bandwidth, high power handling multiple arm waveguide junction comprising:

a multiple arm magic T rectangular waveguide structure having a common junction region where an E input port, an H input port and a pair of output arms are coupled to transfer power, said waveguide structure being formed with multiple ridge waveguides, with at least one central ridge in the H port extending into the junction region and being smoothly merged therein with a ridge from each of said output arms, a pair of impedance matching elements mounted in said junction region in alignment with the H port to respectively impedance match the H and E input ports, one of said elements having a ridge-like smoothly contoured shape and is mounted on the central ridge in alignment with the H port, the combined height of said ridge-shaped matching element and the central ridge on which it is seated being greater than one-half the width of the smaller dimension of the rectangular waveguide, wherein the magic T structure has an electromagnetic plane of symmetry which effectively bisects said E and H ports, and wherein said matching elements are symmetrically located with respect to the symmetry plane, the other matching element being a post which is seated on a wall that is common with the output arms, the height of the post being such that it extends up into the E port, the central ridges in the E port having end segments near the junction region, said end segments having recessed steps which are of reduced height, an iris located in the E port near the junction region for enhanced matching of the E port, and wherein the E and H ports each have necked down segments extending towards the junction region.

21. The waveguide junction as claimed in claim 20, wherein the output arms have necked down segments.

22. The waveguide junction as claimed in claim 21, wherein the necked down segments in the H port include a convergence of the shorter walls of the H port and a convergence of at least one central ridge towards the other.

23. The waveguide junction as claimed in claim 22, wherein the necked down segment in the E port includes a convergence of one short wall of the E port toward the other short wall.

24. The waveguide junction as claimed in claim 23, wherein the necked down segments in the output arms include central ridges which taper to converge toward the other central ridges in the output arms.

* * * * *